US005968403A

United States Patent [19]

Myers et al.

[11] Patent Number: 5,968,403

[45] Date of Patent: Oct. 19, 1999

[54] WALER SYSTEM AND CLAMP FOR CONCRETE WALL FORMS

[76] Inventors: Dallas E. Myers, 4301 Fisher Ave., Middletown; Norman Cottonoim, 314 Dogwood La., Trenton, both of Ohio 45067

[21] Appl. No.: 08/971,398

[22] Filed: Nov. 14, 1997

Related U.S. Application Data

[60] Provisional application No. 60/030,959, Nov. 15, 1996.

[51] Int. Cl.[6] ..... E04G 17/00

[52] U.S. Cl. ..... 249/219.2; 249/44; 249/47; 269/218; 269/236

[58] Field of Search ..... 249/219.1, 219.2, 249/44, 47, 192, 33; 269/236, 235, 218, 164, 167, 169, 249; 254/104; 24/535

[56] References Cited

U.S. PATENT DOCUMENTS

| | | | |
|---|---|---|---|
| Re. 26,710 | 11/1969 | Barnes . | |
| 749,760 | 1/1904 | Townsend | 24/535 X |
| 1,423,162 | 7/1922 | Simpson | 249/219.1 |
| 1,757,321 | 5/1930 | MacDonald . | |
| 2,127,562 | 8/1938 | Jennings . | |
| 2,190,701 | 2/1940 | Colt . | |
| 2,312,983 | 3/1943 | Summers . | |
| 2,340,439 | 2/1944 | Stroben . | |
| 2,610,660 | 9/1952 | Jennings et al. | 249/219.2 X |
| 2,613,424 | 10/1952 | Kenney . | |
| 2,782,483 | 2/1957 | Canio . | |
| 2,819,861 | 1/1958 | Vines . | |
| 2,819,863 | 1/1958 | Vines . | |
| 2,862,277 | 12/1958 | Hillberg . | |
| 2,876,813 | 3/1959 | Jennings . | |
| 2,879,576 | 3/1959 | Imonetti . | |
| 2,882,583 | 4/1959 | Arrighini et al. . | |
| 3,030,059 | 4/1962 | Jahn . | |
| 3,060,541 | 10/1962 | Hillberg . | |
| 3,071,368 | 1/1963 | Harding | 269/218 |
| 3,121,277 | 2/1964 | Dusselier et al. . | |
| 3,218,687 | 11/1965 | Barnes . | |
| 3,235,217 | 2/1966 | Jahn . | |
| 3,315,937 | 4/1967 | Eriksson . | |
| 3,347,510 | 10/1967 | Buyken . | |
| 3,462,107 | 8/1969 | Buyken . | |
| 3,589,666 | 6/1971 | Kirby . | |
| 3,655,162 | 4/1972 | Shoemaker . | |
| 3,712,576 | 1/1973 | Dagiel . | |
| 3,729,159 | 4/1973 | Foster . | |
| 3,792,831 | 2/1974 | Verhey . | |
| 3,815,862 | 6/1974 | Williams . | |
| 4,054,259 | 10/1977 | Johnson . | |
| 4,079,910 | 3/1978 | Miller . | |
| 4,202,540 | 5/1980 | Neff | 269/236 X |
| 4,508,310 | 4/1985 | Schultz . | |
| 4,566,304 | 1/1986 | Van Cleave et al. | 269/236 X |
| 4,881,716 | 11/1989 | Dingler | 249/47 X |
| 5,039,059 | 8/1991 | Miller . | |
| 5,110,083 | 5/1992 | Page . | |
| 5,146,816 | 9/1992 | Badstieber | 269/218 X |
| 5,368,272 | 11/1994 | Badstieber | 249/44 X |

FOREIGN PATENT DOCUMENTS

| | | | |
|---|---|---|---|
| 1208214 | 9/1959 | France | 249/44 |

*Primary Examiner*—Dennis L. Taylor
*Attorney, Agent, or Firm*—Wood, Herron & Evans, L.L.P.

[57] ABSTRACT

A waler system includes a number of clamps each of which has a lower leg including a tab with a hole therein which is secured to the wall form of a poured concrete wall system by a standard pin connection. An upper leg of the clamp translates between a loading/unloading position so that a waler beam can be installed easily and conveniently on the clamp attached to the wall form. Each of the clamps is then simply translated into the clamping position by forcing the upper leg downwardly and inwardly toward the beam and the wall form. After the concrete has been poured and the wall cured, the waler system can be disassembled by simply translating the upper leg of each clamp upwardly and outwardly to disengage the waler beam. The transformation is assisted by a spring captured within the upper leg of each clamp.

9 Claims, 2 Drawing Sheets

WALER SYSTEM AND CLAMP FOR CONCRETE WALL FORMS

This is a continuation-in-part of U.S. Provisional patent application Ser. No. 60/030,959, filed Nov. 15, 1996, which is hereby incorporated by reference.

BACKGROUND OF THE INVENTION

This invention relates to concrete wall forms and, more particularly, to a waler system for concrete wall forms.

The construction of walls with poured concrete normally involves the use of a form system which includes a pair of spaced generally parallel wall forms. Each wall form is constructed with a plurality of aligned panels and the wall forms define a space between them in which the concrete is poured and allowed to cure. The forces tending to separate the wall forms under the tremendous liquid pressure of newly deposited concrete is resisted by a series of tie rods extending between the wall forms and located at the juncture between the adjacent panels of each wall form.

Typically, each panel of each wall form includes a plywood, metal or similar material panel portion reinforced on a back face thereof by flanges extending along the side, top and bottom edges of the panel. The flanges along the side edges of each panel are arranged vertically and are commonly referred to as "studs". The studs or flanges include a plurality of holes which, when aligned with the holes in the flange of the adjacent panel, provide an aperture through which a pin is typically inserted to connect the adjacent panels together and construct the wall form. Commonly, the pin includes a slot through which a wedge is inserted to further secure the assembly.

The displacement of the wall forms as a result of the pressure and forces exerted by the poured concrete is resisted by horizontally extending walers which extend transversely across a plurality of panels on the back side of the wall form. Walers of this type are commonly used to reinforce the wall form against the forces exerted by the concrete and to maintain respective panels in proper alignment to avoid unwanted displacement or wavering in the wall form resulting from misalignment of the respective panels with each other.

The prior art includes numerous waler designs for securing and attaching the waler beams to the back surface of the wall form panels. However, known waler systems typically do not allow for convenient and effective installation of the waler beams to provide a sturdy and effective reinforcement and alignment of the wall form panels. Further, typically the waler systems do not provide for convenient and user friendly attachment and removal of those systems from the wall form panels. Very often each wall form utilizes at least two waler beams including an upper and a lower horizontally extending waler beam. Furthermore, each waler beam requires a plurality of clamps for attachment to the wall form panels. Therefore, the installation and removal of the waler system on a single wall panel can include dozens or more attachment devices. Therefore, the installation and removal of the waler system during the construction of a poured concrete wall can prove to be very time consuming and burdensome for the worker.

Therefore, a need exists in the industry for a waler system which is convenient and easy to install and remove from the wall form panels while still effectively reinforcing the wall forms and maintaining the alignment of the respective panels.

SUMMARY OF THE INVENTION

These and other objectives of the invention have been attained by a waler system according to a presently preferred embodiment of the invention which includes a number of clamps for supporting and securing each waler beam to the back surface of the wall form. Each clamp according to a presently preferred embodiment of the invention includes a lower horizontal leg projecting rearwardly from the wall form panels. A tab projects from the terminal end of the lower leg of each clamp to be positioned between the flanges on the adjacent wall form panels. A hole is provided in the tab for alignment with the holes in the respective adjacent flanges of the panels so that a standard pin or other attachment mechanism can be inserted through the hole in the tab and the holes in the flanges to anchor the clamp to the wall form panels.

An upper leg of the clamp extends generally parallel to the back face of the wall form panels and perpendicular to the lower leg. The upper leg is movable relative to the lower leg and the wall form to and between a loading/unloading position and a clamping position. The clamp is generally L-shaped in the loading/unloading position and the upper leg is spaced farther from the wall form panels than when the clamp is in the clamping position so that the waler beam can be loaded onto the clamp to rest on the lower leg of each clamp without interference from the upper leg. After the waler beam is loaded and is resting on the lower leg of each of the associated clamps, the upper leg is moved into the clamping position so that a gripping pad on the inner face of the upper leg contacts the waler beam which is then clamped between the upper leg and the flanges of the wall form panels. The upper leg of each clamp translates downwardly and inwardly toward the flanges from the loading/unloading position to the clamping position.

After the concrete is poured and the wall is cured, each of the clamps are unclamped to release the waler beam prior to disassembly of the wall forms.

The upper leg is biased by a spring captured within the upper leg toward the loading/unloading position. The lower leg includes an arm which is housed within the shell configuration of the upper leg. The arm includes a pair of slots which capture a pair of pins extending between opposed side walls of the shell to guide the upper leg from the loading/unloading position to the clamping position and vice versa.

The waler system and clamps according to a presently preferred embodiment of this invention can be easily installed and disassembled by merely securing each of the clamps with the pin used to join the adjacent panels of the wall form. Once the clamps are installed on the wall form, the waler beam is placed on the horizontal leg of the associated clamps and the upper leg of each clamp is then forced downwardly into the clamping position by a blow with a hammer, mallet or the like on an upper impact head portion of each upper leg. For removal of the waler beam, an impact base at the base of each upper leg is struck with a mallet, hammer or the like to disengage the leg from the waler beam and translate the clamp into the loading/unloading position. The force required to translate the clamp from clamping position to the loading/unloading position is less than the force required for the opposite operation because the upper leg is spring biased toward the loading/unloading position. Therefore, the installation of the waler system according to a presently preferred embodiment of the invention can be accomplished easily and effectively by the workers to provide a sturdy and effective alignment mechanism for the wall form panels.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
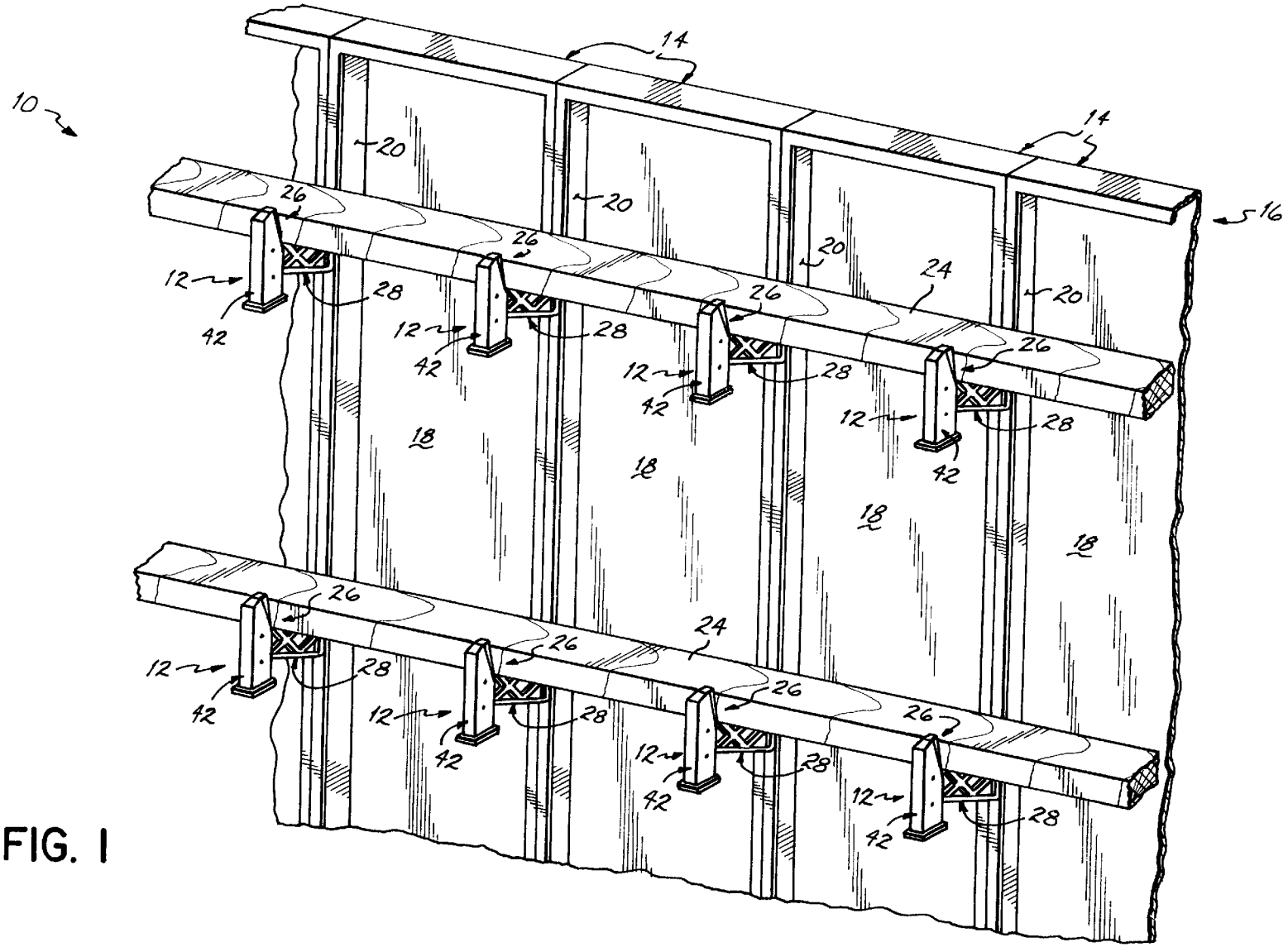
FIG. 1 is a perspective view of a portion of a wall form and waler system according to a presently preferred embodiment of the invention.

Referring to FIG. 1, a presently preferred embodiment of a waler system 10 according to this invention is shown. The waler system 10 includes a number of clamps 12 each of which is attached at the juncture between adjacent panels 14 forming a wall form 16. Each panel 14 includes a planar panel portion 18 and a flange 20 projecting rearwardly from the panel portion 18 along spaced side edges thereof. Each flange 20 includes a plurality of holes 22 (FIGS. 2 and 3) which are aligned with the respective holes 22 in the adjacent panel 14. It will be appreciated by one of ordinary skill in the art that the wall form 16 shown in FIG. 1 is used in conjunction with a similar configured wall form 16 to define a space therebetween into which concrete (not shown) is poured and allowed to cure to form a poured concrete wall (not shown). Additionally, although a particular configuration is shown and described for each of the panels of the wall form, it will be appreciated that the waler system 10 according to this invention can be used on a variety of configurations of panels and wall form designs.

The waler system 10 further includes a waler beam 24 extending generally horizontally across a plurality of adjacent panels 14 forming the wall form 16. Preferably, as shown in FIG. 1, the waler system 10 includes an upper and a lower waler beam 24 to reinforce and align the panels 14 of the wall form 16. The upper and lower waler beams 24 and the associated clamps 12 for each beam 24 are identical to like components according to this invention with the exception of the position of the respective components. Therefore, the following description is directed to an exemplary clamp 12 and waler beam 24 and it will be appreciated by one of ordinary skill in the art to be applicable to the other associated components according to this invention.

The waler beam 24 according to the presently preferred embodiment of the invention is typically a 2×4 or 2×6 wooden or other material beam. The various sizes of the waler beam 24 can be accommodated with appropriately sized and configured clamps 12 according to this invention.

Figure 2:
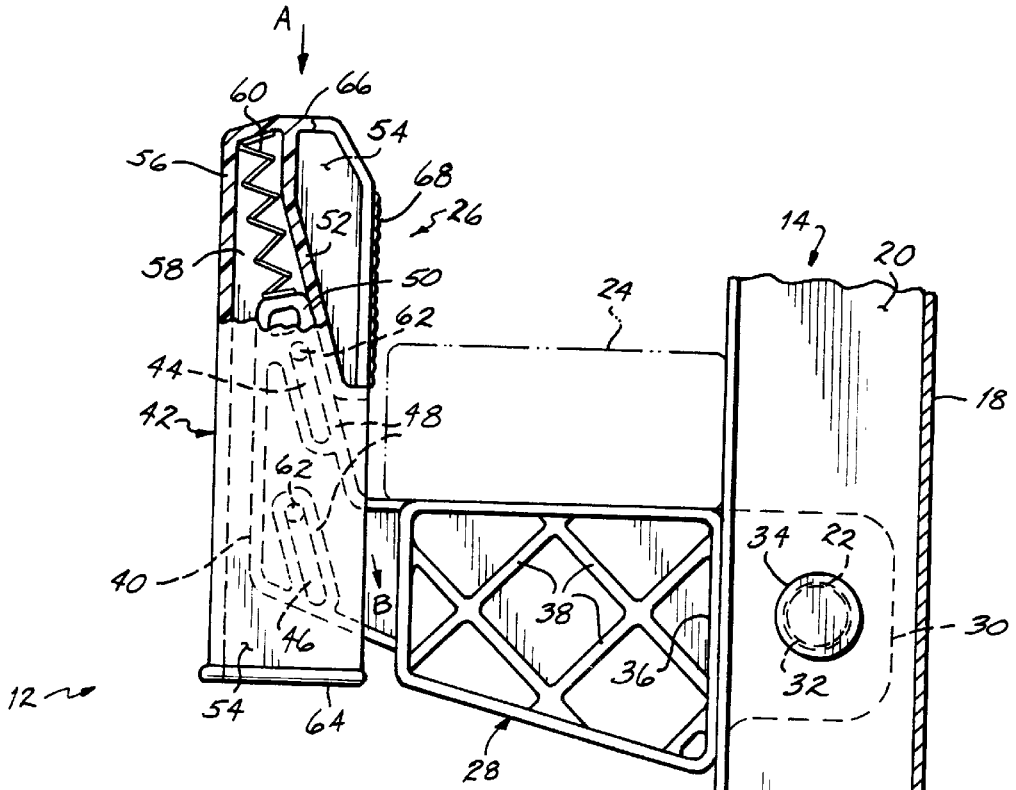
FIG. 2 is a cross-sectional view of a waler clamp in the loading/unloading position secured to the wall form.
Figure 3:
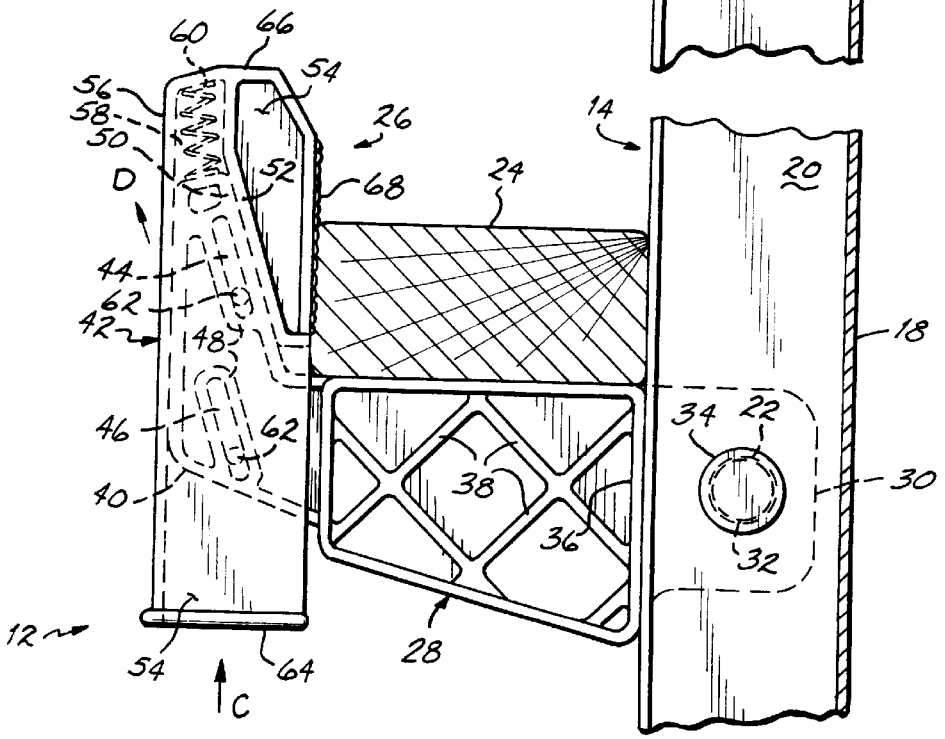
FIG. 3 is a view similar to FIG. 2 with the waler clamp in the clamping position securing the waler beam to the wall form.

With reference to FIGS. 2 and 3, each of the clamps 12 includes an upper leg 26 which is generally parallel to and spaced from the flanges 20 on the wall form panels 14. Each clamp 12 also includes a lower leg 28 which is perpendicular to the upper leg 26 and the flanges 20. A tab 30 is formed on the terminal end of the lower leg 28 for insertion between the flanges 20 on the adjacent wall form panels 14. It will be appreciated that a notch or cut-out (not shown) may be provided in each of the flanges 20 to accommodate the tab 30 therebetween. A hole 32 is provided in the tab 30 which is sized and configured similar to the holes 22 in the flanges 20 so that the clamp 12 can be secured to the flanges 20 by aligning the hole 32 in the tab 30 with the holes 22 in the flanges 20 of the adjacent panels 14 a nd inserting a pin 34 therethrough. The pin 34 may include a slot (not shown) through which a wedge (not shown) can be inserted to securely anchor the pin 34 and join the adjacent flanges 20 and panels 14 together as is well known in the art.

The tab 30 , according to the presently preferred embodiment of the invention, is thinner than the lower leg 28 of the clamp 12 to which it is attached so that an inner portion of a peripheral rim 36 formed on the lower leg 28 is juxtaposed against an outer edge of the flange 20 in an abutting relationship. As a result, when the clamp 12 is secured to the flanges 20 as described herein and shown in FIGS. 2 and 3, the clamp 12 is prevented from rotating about the pin 34 relative to the flanges 20 due to the interaction of the inner portion of the rim 36 and the flange 20.

The lower leg 28 preferably includes a plurality of ribs 38 forming an interconnected pattern of rectangles or squares on the lower leg 28 to add strength thereto without significantly increasing the weight of the clamps 12. The upper surface of the lower leg 28 is generally flat and extends perpendicularly to the flanges 20 so that a generally rectangular shaped cross-section of the waler beam 24 can rest on the upper surface of the lower leg 28 as shown in FIG. 3.

An arm 40 projects outwardly and upwardly from the lower leg 28 and is covered by a shell 42 to form the upper leg 26 of the clamp 12. Preferably, the arm 40, lower leg 28 and tab 30 are all integrally formed from steel, aluminum or another metal or molded as an integral unit from glass filled nylon or another material. The arm 40 includes an upper and lower slot 44, 46 respectively, which are each formed by generally oval shaped rims 48 in the body of the arm 40. An upper tapered edge 50 of the arm 40 is formed for sliding contact with a similarly tapered internal rib 52 formed in the shell 42 of the upper leg 26. The shell 42 further includes a pair of spaced sidewalls 54 between which the arm 40 is sandwiched. A peripheral border 56 separates the sidewalls 54 of the shell 42 and extends lengthwise along the shell 42 along an outer surface thereof and upwardly around the top of the shell 42 and then downwardly along the top half of an inner portion of the shell 42. The tapered internal rib 52 of the shell 42 in cooperation with the border 56 forms a cavity 58 in which a spring 60 is housed between the sidewalls of the shell 42. The spring 60 is captured between the upper end of the border 56 of the shell 42 and the upper end of the arm 40 as shown in FIGS. 2 and 3 to bias the upper leg 26 upwardly into a loading/unloading position as shown in FIG. 2. The upper leg 26 translates relative to the lower leg 28 into a clamping position as shown in FIG. 3 and a pair of pins 62, each of which is captured in one of the slots 44 or 46 in the arm 40, in cooperation with the sliding upper tapered edge 50 of the arm 40 and the tapered internal rib 52, guides the upper leg 26 to and between the respective positions.

The base of the shell 42 includes an enlarged impact base 64 and likewise the upper end of the shell 42 can be reinforced to provide an impact head 66 for the purposes of which will be described herein below.

The inner surface of the upper leg 26 preferably includes a gripping pad 68 comprising a plurality of serrations or teeth to increase the gripping force with the waler beam 24 when the clamp 12 is in the clamping position of FIG. 3. Preferably, the shell 42 is molded from glass filled nylon, metal or another material and the pins 62 are advantageously enclosed in the shell 42 so that translation of the pins 62 within the slots 44, 46 cannot be fouled by concrete, dirt or other foreign matter.

Installation of the waler system 10 according to this invention is easily accomplished by securing a number of clamps 12 to the wall form 16. The clamps 12 are connected to the wall form 16 at the juncture between the adjacent panels 14 by inserting the pin 34 through the aligned holes 22 in the flanges 20 and through the hole 32 in the tab 30 on the lower leg 28 of the clamp 12. After the appropriate number of horizontally aligned clamps 12 is secured by pins 34 to the wall form 16, the waler beam 24 is placed on the upper surface of the lower leg 28 of each clamp 12 in the loading/unloading generally L-shaped configuration shown in FIG. 2. In the loading/unloading position the inner surface of the upper leg 26 is spaced from the waler beam 24 to provide for easy and efficient installation of the waler beam 24 on the clamps 12 without interference of the upper leg 26.

Each of the clamps 12 are then translated into the clamping position of FIG. 3 by forcing the shell 42 downwardly and inwardly as shown by arrows A and B of FIG. 2 so that the spring is compressed and that the griping pad 68 engages the outer surface of the waler beam 24 to thereby clamp the waler beam 24 against the flanges 20 of the wall form 16 and provide for reinforcement and alignment of the respective panels 14. Once each of the clamps 12 is translated into the clamping position of FIG. 3, the concrete is poured between the wall forms 16 and allowed to cure thereby forming the concrete wall.

Disassembly of the waler system 10 according to the present invention is easily accomplished by impacting the impact base 64 on the shell 42 of the upper leg 26 as shown by arrow C and thereby translating the shell 42 upwardly and outwardly in the direction of arrow D to disengage the gripping pad 68 from the waler beam 24. The force required to disengage the upper leg 26 of the clamp 12 from the waler beam 24 is assisted by the biasing force of the spring 60 urging the upper leg 26 upwardly and outwardly away from the beam 24. As the clamp 12 is transformed to and between the loading/unloading position of FIG. 2 and the clamping position of FIG. 3, the pins 62 translate within the slots 44, 46 and the tapered edge 50 of the arm 40 and the internal rib 52 of the shell 42 cooperate to guide and stabilize the movement of the upper leg 26.

It would be appreciated that the installation and disassembly of the waler system 10 can be easily accomplished by reconfiguring the clamps 12 to and between the loading/unloading position and the clamping position by a hammer, mallet or the like striking the impact base 64 or impact head 66 of the upper leg 26 as appropriate. Furthermore, the clamping force of the clamps 12 according to the presently preferred embodiment of the waler system 10 provides a sturdy and stable reinforcement and alignment of the panels 14 of the wall form 16 while still providing for convenient installation and disassembly.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A waler system to align and reinforce a plurality of adjacent panels forming a poured concrete wall form, each of the panels having a generally planar panel portion and a flange extending along each side edge thereof from a rear surface of the panel portion, each panel being positioned next to a similarly oriented adjacent panel with the flanges of the adjacent panels being juxtaposed to each other, each flange having holes therein which are aligned with similar holes in the flange of the adjacent panel so that pins can be inserted into the aligned holes to connect the panels together and form the wall form, the waler system comprising:

a plurality of clamps, each clamp having a lower leg and an upper leg generally perpendicular thereto, the lower leg having a hole proximate a terminal end thereof which is adapted to be aligned with the holes in the flanges of the adjacent wall form panels so that the pin can be inserted through the hole in the lower leg of the clamp and the holes in the flanges to mount the clamp to the wall form panels with the upper leg of the clamp being spaced from and parallel to the wall form; and a waler beam;

wherein the upper leg of each clamp is movable relative to the lower leg and the wall form to and between a loading/unloading position and a clamping position in which the upper leg in the loading/unloading position is spaced farther from the flanges than when in the clamping position so that the waler beam can be loaded onto the clamps to rest on the respective lower legs thereof and the upper leg of each clamp is then moved into the clamping position to clamp the waler beam to the wall form and align and reinforce the associated panels during the pouring and curing of the concrete wall after which the upper leg of each clamp is moved from the clamping position to the loading/unloading position and the waler beam removed from the associated clamps.

2. The waler system of claim 1 wherein the upper leg of each clamp is spring biased toward the loading/unloading position, the lower leg of each clamp having an arm on outer end thereof which includes two slots, the arm being covered by a shell to form the upper leg of the clamp, the shell having a pair of spaced walls and a pair of pins extending between the spaced walls, each of the pins being captured in one of the slots in the arm, the upper leg further comprising a spring positioned between an upper end of the arm and an upper wall of the shell to bias the clamp toward the loading/unloading position, the shell also comprising a friction pad for gripping the waler beam when the clamp is in the clamping position and an impact base and impact head to receive an impact blow to translate the clamp from the clamping position to the loading/unloading position and from the loading/unloading position to the clamping position, respectively.

3. A waler system to align and reinforce a plurality of adjacent panels forming a wall form for a poured concrete wall, each of the panels being coupled to an adjacent panel by connecting hardware, the waler system comprising:

a waler beam; and a plurality of clamps for releasably securing the waler beam to the wall form panels, each of the clamps having a lower leg and an upper leg generally perpendicular thereto and a biasing mechanism, the upper leg being movable to and between a clamping position and a loading/unloading position, the upper leg being biased by the biasing mechanism toward the loading/unloading position for loading and unloading the waler beam on the clamp and the clamping position for clamping the waler beam to the wall form.

4. The waler system of claim 3 further comprising:

a tab projecting from a first end of the lower leg, the tab having a hole therethrough and being sized and configured for insertion between adjacent panels of the wall form, the hole being sized and configured for receiving therethrough a pin used to couple the adjacent panels together.

5. The waler system of claim 3 further comprising:

a gripping pad on an inner surface of the upper leg, the gripping pad engaging the waler beam when the upper leg is in the clamping position.

6. The waler system of claim 3 further comprising:

an arm projecting from a second end of the lower leg, the arm being captured within the upper leg.

7. The waler system of claim 6 further comprising:

a biasing element captured within the upper leg and positioned relative to the arm to bias the upper leg toward the loading/unloading position.

8. The waler system of claim 6 further comprising:

a pin captured within a slot, the pin and the slot cooperating to couple the upper and lower legs together and to guide the upper leg to and between the loading/unloading position and the clamping position.

9. The waler system of claim 3 further comprising:

an impact base on the upper leg; and an impact head on the upper leg, the impact base and the impact head providing a location to strike the upper leg to move it from the clamping position to the loading/unloading position and from the loading/unloading position to the clamping position, respectively.

* * * * *